US007069888B2

(12) United States Patent
Yang et al.

(10) Patent No.: US 7,069,888 B2
(45) Date of Patent: Jul. 4, 2006

(54) SYSTEM AND METHOD FOR VALVE ACTUATION

(76) Inventors: Zhou Yang, 8 Diggins Ct., South Windsor, CT (US) 06074; Brian Ruggiero, 14 Seneca Dr., East Granby, CT (US) 06026

( * ) Notice: Subject to any disclaimer, the term of this patent is extended or adjusted under 35 U.S.C. 154(b) by 0 days.

(21) Appl. No.: 11/012,324

(22) Filed: Dec. 16, 2004

(65) Prior Publication Data

US 2005/0145216 A1 Jul. 7, 2005

Related U.S. Application Data

(60) Provisional application No. 60/532,889, filed on Dec. 30, 2003.

(51) Int. Cl.
*F01L 9/02* (2006.01)

(52) U.S. Cl. ..... 123/90.12; 123/90.46; 123/90.55

(58) Field of Classification Search ..... 123/90.12, 123/90.22, 90.23, 90.25, 90.26, 90.43, 90.46, 123/90.52, 90.55, 321, 90.15
See application file for complete search history.

(56) References Cited

U.S. PATENT DOCUMENTS 3,220,392 A 11/1965 Cummins
4,384,558 A * 5/1983 Johnson ..... 123/321
4,742,806 A * 5/1988 Tart et al. ..... 123/322
5,386,809 A * 2/1995 Reedy et al. ..... 123/320
5,406,918 A * 4/1995 Joko et al. ..... 123/321
5,485,819 A * 1/1996 Joko et al. ..... 123/321
5,601,057 A * 2/1997 Treyz et al. ..... 123/90.16
5,996,550 A * 12/1999 Israel et al. ..... 123/322
6,189,504 B1 2/2001 Israel et al.
6,594,996 B1 7/2003 Yang
6,827,067 B1 * 12/2004 Yang et al. ..... 123/568.14
6,883,492 B1 * 4/2005 Vanderpoel et al. ..... 123/321

* cited by examiner

*Primary Examiner*—Mahmoud Gimie
(74) *Attorney, Agent, or Firm*—David R. Yohannan; Kelley Drye & Warren LLP

(57) ABSTRACT

The present invention is directed to a system and method for actuating an engine valve. In one embodiment, the present invention is a system for providing exhaust gas recirculation (EGR) in an engine having at least one engine valve, the system comprising: means for imparting a valve train motion; a first valve actuation subsystem for transferring motion from the motion imparting means to the engine valve, the first valve actuation subsystem capable of providing valve actuation for at least a portion of a main exhaust event during a first engine operating condition, and a full main exhaust event during a second engine operating condition; and a second valve actuation subsystem for transferring motion from the motion imparting means to the engine valve, the second valve actuation subsystem capable of providing valve actuation for an exhaust gas recirculation event during the first engine operating condition.

6 Claims, 3 Drawing Sheets

SYSTEM AND METHOD FOR VALVE ACTUATION

CROSS-REFERENCE TO RELATED APPLICATION

This application claims priority on U.S. Provisional Patent Application Ser. No. 60/532,889, for System and Method for Valve Actuation, filed on Dec. 30, 2003, the entirety of which is incorporated herein by reference.

FIELD OF THE INVENTION

The present invention relates generally to a system and method for actuating one or more valves in an engine. In particular, the present invention relates to systems and methods for actuating one or more engine valves to produce an engine valve event such as, for example, a main valve event (exhaust and/or intake), a compression release braking event, a bleeder braking event, an exhaust gas recirculation event, and/or other auxiliary valve events.

BACKGROUND OF THE INVENTION

Valve actuation in an internal combustion engine is required in order for the engine to produce positive power, engine braking, and exhaust gas recirculation (EGR). During positive power, one or more intake valves may be opened to admit fuel and air into a cylinder for combustion. One or more exhaust valves may be opened to allow combustion gas to escape from the cylinder. Intake, exhaust, and/or auxiliary valves may also be opened during positive power at various times to recirculate gases for improved emissions.

Engine valve actuation also may be used to produce engine braking and exhaust gas recirculation when the engine is not being used to produce positive power. During engine braking, one or more exhaust valves may be selectively opened to convert, at least temporarily, the engine into an air compressor. In doing so, the engine develops retarding horsepower to help slow the vehicle down. This can provide the operator with increased control over the vehicle and substantially reduce wear on the service brakes of the vehicle.

Engine valve(s) may be actuated to produce compression-release braking and/or bleeder braking. The operation of a compression-release type engine brake, or retarder, is well known. As a piston travels upward during its compression stroke, the gases that are trapped in the cylinder are compressed. The compressed gases oppose the upward motion of the piston. During engine braking operation, as the piston approaches the top dead center (TDC), at least one exhaust valve is opened to release the compressed gases in the cylinder to the exhaust manifold, preventing the energy stored in the compressed gases from being returned to the engine on the subsequent expansion down-stroke. In doing so, the engine develops retarding power to help slow the vehicle down. An example of a prior art compression release engine brake is provided by the disclosure of Cummins, U.S. Pat. No. 3,220,392 (November 1965), which is incorporated herein by reference.

The operation of a bleeder type engine brake has also long been known. During engine braking, in addition to the normal exhaust valve lift, the exhaust valve(s) may be held slightly open continuously throughout the remaining engine cycle (full-cycle bleeder brake) or during a portion of the cycle (partial-cycle bleeder brake). The primary difference between a partial-cycle bleeder brake and a full-cycle bleeder brake is that the former does not have exhaust valve lift during most of the intake stroke. An example of a system and method utilizing a bleeder type engine brake is provided by the disclosure of Assignee's U.S. Pat. No. 6,594,996 (Jul. 22, 2003), a copy of which is incorporated herein by reference.

The basic principles of exhaust gas recirculation (EGR) are also well known. After a properly operating engine has performed work on the combination of fuel and inlet air in its combustion chamber, the engine exhausts the remaining gas from the engine cylinder. An EGR system allows a portion of these exhaust gases to flow back into the engine cylinder. This recirculation of gases into the engine cylinder may be used during positive power operation, and/or during engine braking cycles to provide significant benefits.

During positive power operation, an EGR system is primarily used to improve engine emissions. During engine positive power, one or more intake valves may be opened to admit fuel and air from the atmosphere, which contains the oxygen required to burn the fuel in the cylinder. The air, however, also contains a large quantity of nitrogen. The high temperature found within the engine cylinder causes the nitrogen to react with any unused oxygen and form nitrogen oxides (NOx). Nitrogen oxides are one of the main pollutants emitted by diesel engines. The recirculated gases provided by an EGR system have already been used by the engine and contain only a small amount of oxygen. By mixing these gases with fresh air, the amount of oxygen entering the engine may be reduced and fewer nitrogen oxides may be formed. In addition, the recirculated gases may have the effect of lowering the combustion temperature in the engine cylinder below the point at which nitrogen combines with oxygen to form NOx. As a result, EGR systems may work to reduce the amount of NOx produced and to improve engine emissions. Current environmental standards for diesel engines, as well as proposed regulations, in the United States and other countries indicate that the need for improved emissions will only become more important in the future.

An EGR system may also be used to optimize retarding power during engine braking operation. As discussed above, during engine braking, one or more exhaust valves may be selectively opened to convert, at least temporarily, the engine into an air compressor. By controlling the pressure and temperature in the engine using EGR, the level of braking may be optimized at various operating conditions.

Generally, there are two types of EGR systems, internal and external. Many conventional EGR systems are external systems, which recirculate the gases from the exhaust manifold to the intake port through external piping. Some external EGR systems require several additional components, such as, external piping, bypass lines, and related cooling mechanisms, in order for the system to operate properly. These additional components may significantly increase the cost of the vehicle, and may increase the space required for the system, creating packaging and manufacturing concerns. Many conventional internal EGR systems provide EGR by taking exhaust gas into the combustion chamber through an open exhaust valve during the intake stroke, or through an open intake valve during the exhaust stroke.

In many internal combustion engines, the valve train motion for producing an engine valve event in a first cylinder may be used to produce an internal exhaust gas recirculation event in a second cylinder. For example, the motion provided by the main intake valve event lobe on the cam of the first cylinder may be used to produce an EGR event in the second cylinder. Some "cross-actuated" EGR systems, however, may be difficult to package within the constraints of a vehicle.

An advantage of embodiments of the present invention is that engine intake and exhaust valves may be opened and closed by fixed profile cams, and more specifically by one or more fixed lobes which may be an integral part of each of the cams. Using, for example, an EGR lobe ground into the cam of the same engine cylinder where the valve event is to occur may significantly reduce packaging difficulties. Other benefits such as increased performance, improved fuel economy, lower emissions, and better vehicle drivability may be obtained by optimizing the engine valve timing and lift.

The use of fixed profile cams, however, can make it difficult to adjust the timings and/or amounts of engine valve lift to optimize them for various engine operating conditions. One method of adjusting valve timing and lift, given a fixed cam profile, has been to provide valve actuation that incorporates a "lost motion" system in the valve train linkage between the valve and the cam. Lost motion is the term applied to a class of technical solutions for modifying the valve motion proscribed by a cam profile with a variable length mechanical, hydraulic, and/or other linkage assembly. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

The systems and methods of the present invention may be particularly useful in engines requiring valve actuation for positive power, engine braking valve events and/or EGR/BGR valve events. The systems and methods of various embodiments of the present invention may provide a lower cost, production viable variable valve actuation system that are more easily packaged than other engine EGR systems. Additional advantages of embodiments of the invention are set forth, in part, in the description which follows and, in part, will be apparent to one of ordinary skill in the art from the description and/or from the practice of the invention.

SUMMARY OF THE INVENTION

Responsive to the foregoing challenges, Applicant has developed innovative systems and methods for actuating one or more engine valves. In one embodiment, the present invention is a system for providing exhaust gas recirculation (EGR) in an engine having at least one engine valve. The system may comprise: means for imparting a valve train motion; a first valve actuation subsystem for transferring motion from the motion imparting means to the engine valve, the first valve actuation subsystem capable of providing valve actuation for at least a portion of a main exhaust event during a first engine operating condition, and a full main exhaust event during a second engine operating condition; and a second valve actuation subsystem for transferring motion from the motion imparting means to the engine valve, the second valve actuation subsystem capable of providing valve actuation for an exhaust gas recirculation event during the first engine operating condition.

Applicant has further developed an innovative method of providing exhaust gas recirculation in an engine. The method may comprise the steps of: providing engine valve train motion to a first valve actuation subsystem and a second valve actuation subsystem; during a first engine operating condition, providing valve actuation for a main exhaust event using the first valve actuation subsystem and the second valve actuation subsystem, and an exhaust gas recirculation event using the first valve actuation subsystem; and during a second engine operating condition, providing valve actuation for a main exhaust event using the first valve actuation subsystem.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference numerals refer to like elements. The drawings are exemplary only, and should not be construed as limiting the invention.

DETAILED DESCRIPTION OF PREFERRED EMBODIMENTS OF THE INVENTION

Reference will now be made in detail to embodiments of the system and method of the present invention, examples of which are illustrated in the accompanying drawings. As embodied herein, the present invention includes systems and methods of controlling the actuation of engine valves.

Figure 1:
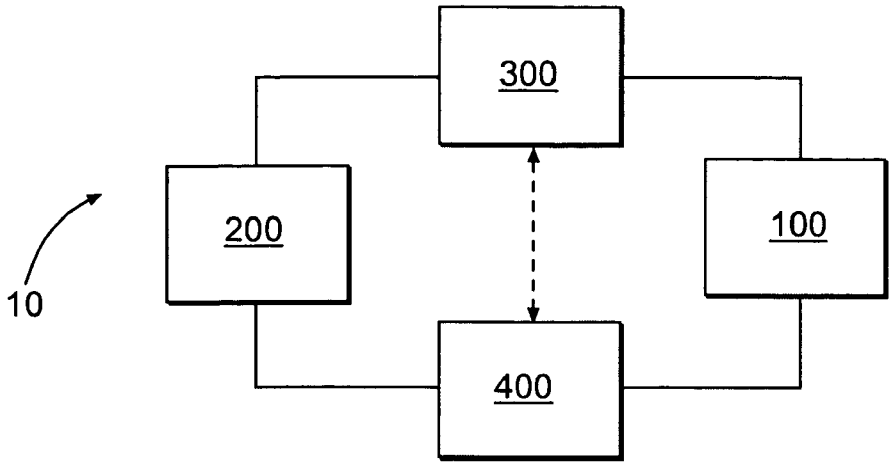
FIG. 1 is a schematic diagram of a valve actuation system according to a first embodiment of the present invention.

An embodiment of the present invention is shown schematically in FIG. 1 as valve actuation system 10. The valve actuation system 10 includes a means for imparting a valve train motion 100 to one or more engine valves 200, a first valve actuation subsystem 300 and a second valve actuation subsystem 400. The motion imparting means 100 is operatively connected to the first valve actuation subsystem 300, which in turn selectively actuates the engine valves 200. The first valve actuation subsystem 300 is operatively connected to the second valve actuation subsystem 400, which in turn selectively actuates the engine valves 200. The first valve actuation subsystem 300 and the second valve actuation subsystem 400 may actuate the engine valve 200 independent of each other.

Figure 5:
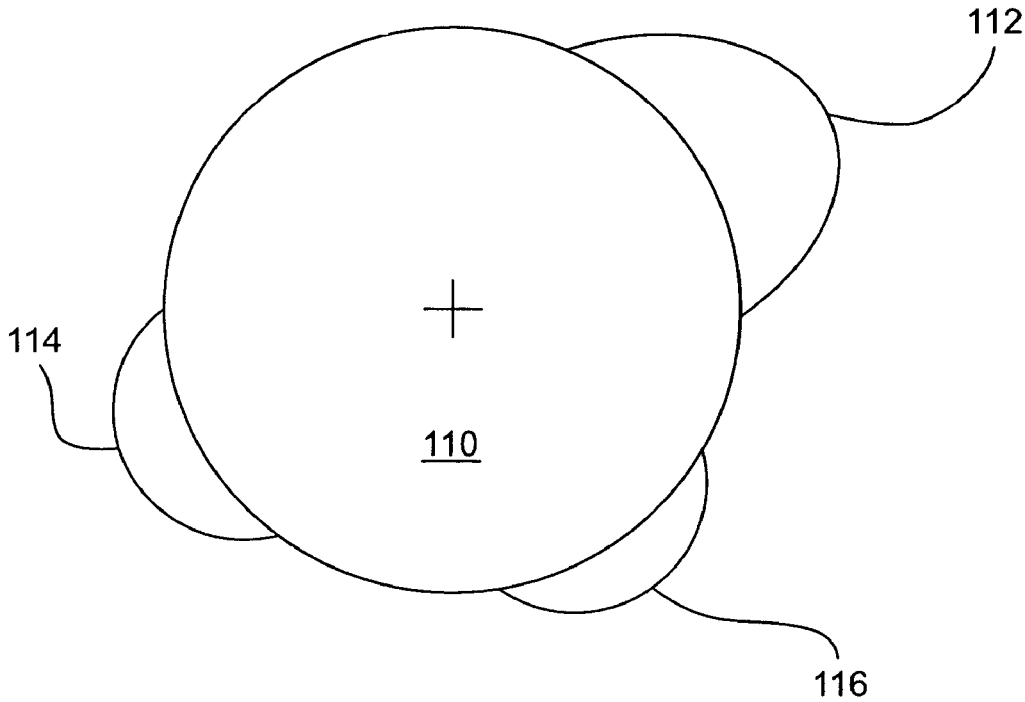
FIG. 5 is a schematic diagram of a cam according to an embodiment of the present invention.

The motion imparting means 100 may comprise any combination of cam(s), push tube(s), or their equivalents, adapted to impart a valve train motion. In at least one embodiment of the present invention, the motion imparting means 100 comprises a cam 110. The cam 110 may comprise an exhaust cam, an intake cam, an injector cam, and/or a dedicated cam. The cam 110 may include one or more cam lobes for producing an engine valve event(s). With reference to FIG. 5, in a preferred embodiment, the cam 110 includes a main (exhaust or intake) event lobe 112, an engine braking lobe 114, and an EGR lobe 116. The depictions of the lobes on the cam 110 are intended to be illustrative only, and not limiting. It is appreciated that the number, combination, size, location, and shape of the lobes may vary markedly without departing from the intended scope of the present invention.

Figure 2:
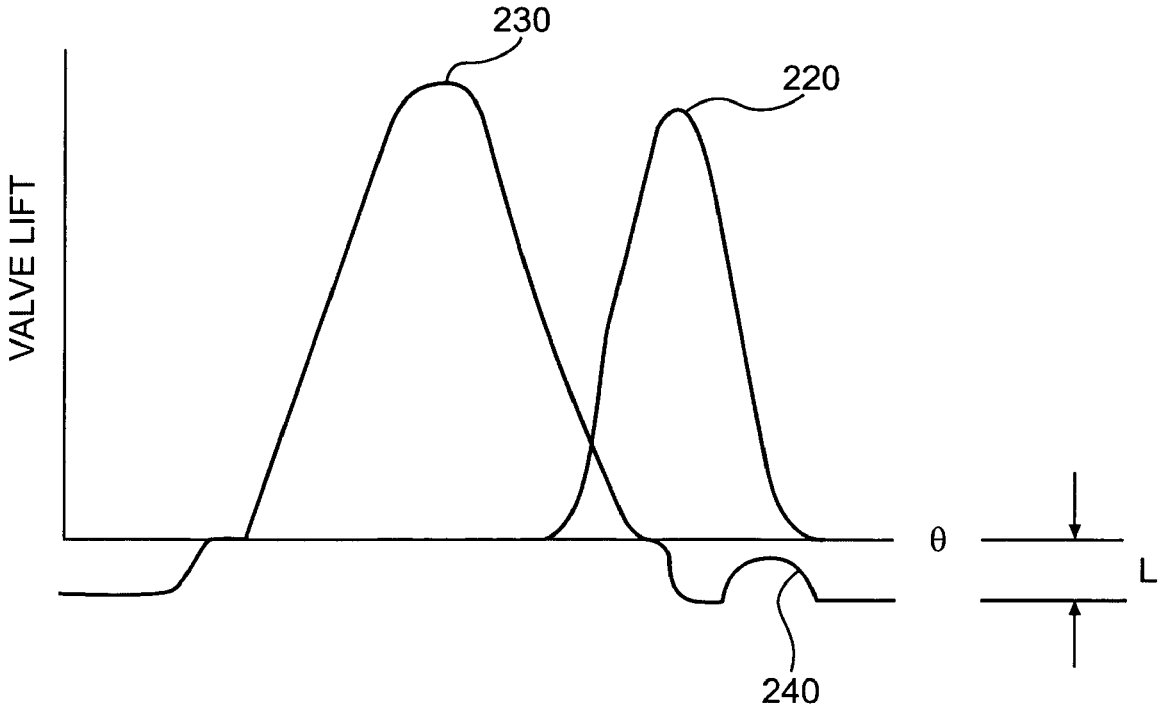
FIG. 2 is a valve lift diagram according to an embodiment of the valve actuation system of the present invention.

With reference to FIG. 2, in at least one embodiment of the present invention, valve actuation system 10 is adapted to provide a main exhaust event 230 and/or a main intake event 220 of constant magnitude during both positive power and engine braking, and to selectively provide an exhaust gas recirculation event 240. The first valve actuation subsystem 300 is capable of providing valve actuation for at least a portion of the main exhaust event 220 during a first operating condition, and the entire main exhaust event during a second engine operating condition. The second valve actuation subsystem 400 is capable of providing valve actuation for an exhaust gas recirculation event 240 during the first engine operating condition.

The motion imparting means 100 is adapted to apply motion to the first valve actuation subsystem 300 and the second valve actuation subsystem 400. The second valve actuation system 400 may be selectively controlled to (1) transfer or (2) not transfer motion to the valves 200. The second valve actuation subsystem 400 may also be adapted to modify the amount and timing of the motion transferred to the engine valves 200.

When operating in the motion transfer mode, the second valve actuation subsystem 300 may actuate the engine valves 200 to produce an exhaust gas recirculation valve event. The first valve actuation subsystem 300 and the second valve actuation subsystem 400 may also actuate the engine valves 200 to produce other engine valve events, such as, but not limited to, main intake, main exhaust, compression release braking, and/or bleeder braking. The valve actuation system 10, including the second valve actuation subsystem 400, may be switched between the modes of transferring motion and not transferring motion in response to a signal or input from a controller 500. The engine valves 200 may be one or more exhaust valves, intake valves, or auxiliary valves.

The first valve actuation subsystem 300 and the second valve actuation subsystem 400 may comprise any structure capable of selectively transmitting motion from the motion imparting means 100 to actuate the valves 200. The first valve actuation subsystem 300 and the second valve actuation subsystem 400 may comprise, for example, a mechanical linkage, a hydraulic linkage, a hydro-mechanical linkage, an electromechanical linkage, an electromagnetic linkage, an air linkage, and/or any other linkage adapted to selectively transmit motion.

When it incorporates a hydraulic circuit, the first valve actuation subsystem 300 and/or the second valve actuation subsystem 400 may be operatively connected to means for supplying hydraulic fluid to and from the respective subsystem. The supply means may include means for adjusting the pressure of, or the amount of, fluid in the circuit, such as, for example, trigger valve(s), control valve(s), accumulator(s), check valve(s), fluid supply source(s), and/or other devices used to release hydraulic fluid from a circuit, add hydraulic fluid to a circuit, or control the flow of fluid in a circuit.

The controller 500 may comprise any electronic, mechanical, hydraulic, electro-hydraulic, or other type of control device for communicating with the first valve actuation subsystem 300 and/or the second valve actuation subsystem 400, and causing it to either transfer the motion, or not transfer some or all of the motion, to the engine valves 200. The controller 500 may include a microprocessor, linked to other engine component(s), to determine and select the appropriate operation of the first valve actuation subsystem 300 and/or the second valve actuation subsystem 400. Positive power, engine braking, and/or EGR operation may be achieved and optimized at a plurality of engine operating conditions (e.g., speeds, loads, etc.) by controlling the first valve actuation subsystem 300 and/or the second valve actuation subsystem 400 based upon information collected by the microprocessor from the engine component(s). The information collected may include, without limitation, engine speed, vehicle speed, oil temperature, manifold (or port) temperature, manifold (or port) pressure, cylinder temperature, cylinder pressure, particulate information, and/or crank angle.

Figure 3:
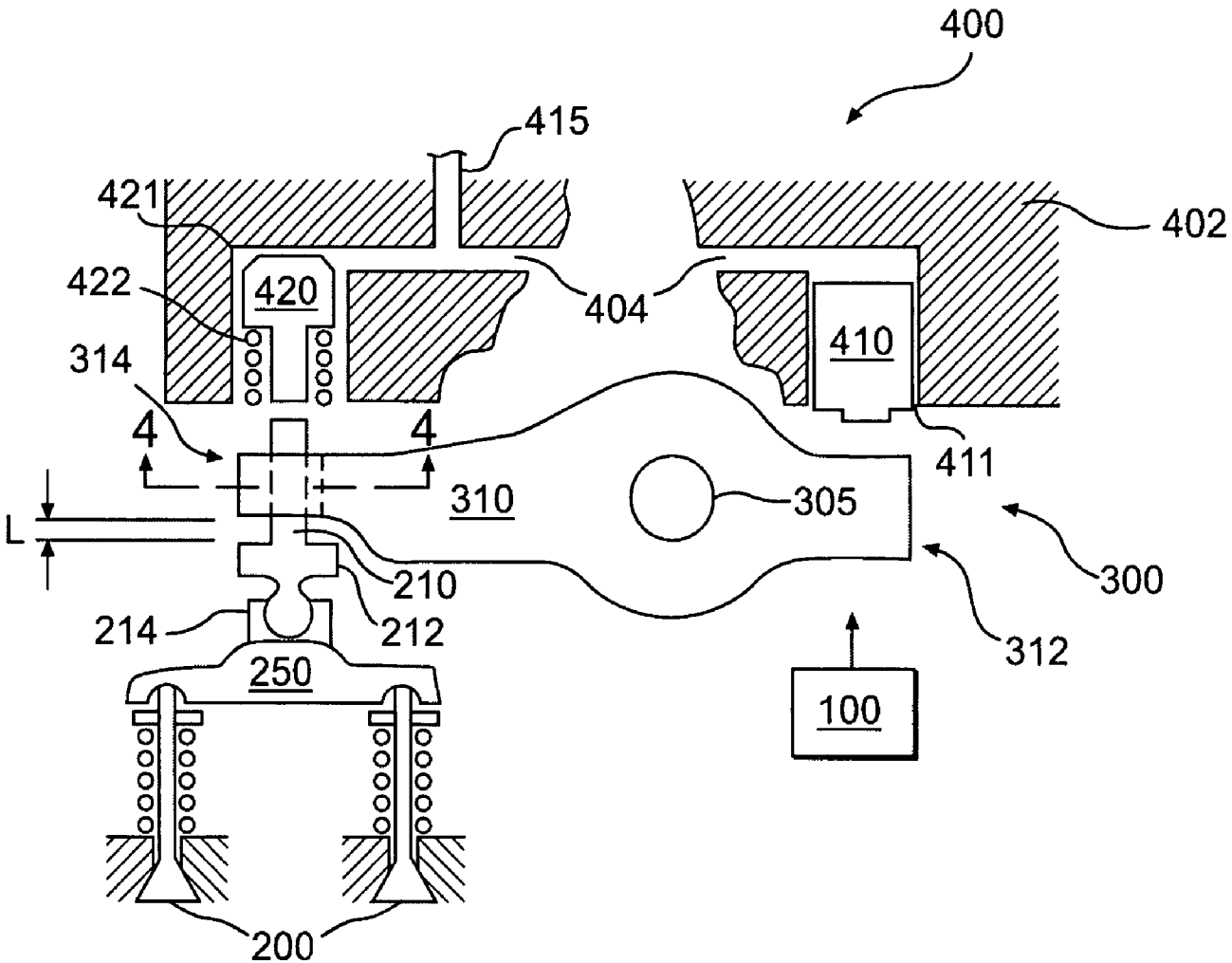
FIG. 3 is a schematic diagram of a valve actuation system according to a second embodiment of the present invention.

A second embodiment of the valve actuation system 10 of the present invention is shown in FIG. 3. The first valve actuation subsystem 300 is disposed intermediate of the second valve actuation subsystem 300 and the engine valve(s) 200. The first valve actuation subsystem 300 comprises a rocker arm 310 having a central opening 305 for receipt of a rocker shaft, a first end 312 for contacting the motion imparting means 100, and a second end 314. The rocker arm 310 is adapted to pivot back and forth about the central opening 305.

The one or more engine valves 200 may be intake, exhaust, or auxiliary valves that provide selective communication between an engine cylinder and the intake or exhaust manifolds of an engine. In the embodiment shown in FIG. 3, a valve bridge 250 is provided between the first valve actuation subsystem 300 and the engine valves 200. The valve bridge 250 may enable actuation of two or more valves. It is appreciated that the valve actuation system 10 may not include a valve bridge 250 in alternative embodiments of the present invention.

With continued reference to FIG. 3, the second valve actuation subsystem 400 may be provided in a fixed housing 402 disposed above the first valve actuation subsystem 300 and the engine valves 200. The housing 402 may include a first bore 411 and a second bore 412 formed therein. The first bore 411 and the second bore 412 are in fluid communication through a hydraulic fluid passage 404 which extends through the housing 402.

A fluid supply passage 415 may communicate with the passage 404. The supply passage 415 may be connected to means for supplying hydraulic fluid to the second valve actuation subsystem 400. The supply means may be adapted to control the supply of hydraulic fluid to and from the hydraulic passage 404, and, correspondingly, may switch the second valve actuation subsystem 400 between modes of transferring, and not transferring, the motion input from the cam 110 based on a signal received from the controller 500. In one embodiment, the supply means may comprise a fluid supply source, and one or more control valves (not shown). The one or more control valves may be selectively switched between modes of communicating, and not communicating, hydraulic fluid from the source to the hydraulic passage 404. It is contemplated that the supply means may include any combination of devices necessary for supplying hydraulic fluid to and from the second valve actuation subsystem 400.

A master piston 410 may be slidably disposed in the first bore 411 such that it may slide back and forth in the bore 411 while maintaining a hydraulic seal with the housing 402. A slave piston 420 may be slidably disposed in the second bore 421 such that it may slide back and forth in the bore 421 while maintaining a hydraulic seal with the housing 402. A spring 422 may bias the slave piston 420 in an upward direction within the bore 421. The slave piston 420 is in fluid communication with the master piston 410 through a hydraulic passage 404 formed in the housing 402.

The second valve actuation subsystem 400 may have a predetermined hydraulic ratio based upon the relative sizes between the master piston 410 and the slave piston 420. The first valve actuation subsystem 300 may have a predetermined rocker arm ratio based upon the specifications of the rocker arm 310. In a preferred embodiment of the present invention, the hydraulic ratio of the second valve actuation subsystem 400 is less than the rocker arm ratio of the first valve actuation subsystem 300.

Figure 4:
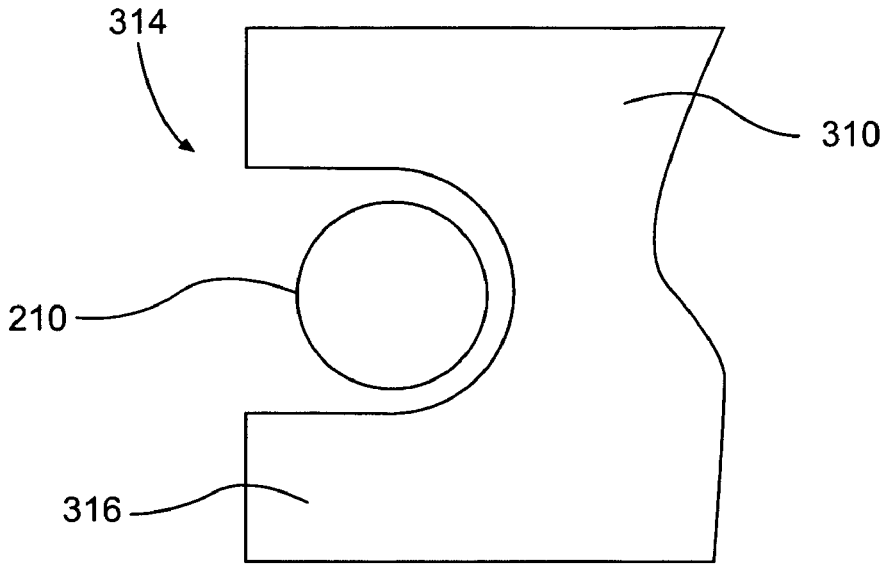
FIG. 4 is a top view of a portion of the valve actuation system shown in FIG. 3.

An actuation pin 210 may be disposed intermediate the second valve actuation subsystem 400 and the engine valves 200. As shown in FIG. 4, the pin 210 is slidably received in a recess 316 formed in the second end 314 of the rocker arm 310. In one embodiment, as shown in FIG. 3, the recess 316 may be fork-shaped, permitting movement of the pin 210 independent of the rocker arm 310. The pin 210 may include a rocker contact surface 212 and a foot 214 for contacting the valve bridge 250. As shown in FIG. 3, a lash, L, may be formed between the rocker 310 and the rocker contact surface 212.

The embodiment of the present invention shown in FIG. 3 may be operated as follows to provide engine valve actuation. During a first operating condition, for example, when EGR is desired, hydraulic fluid may be supplied to the second valve actuation subsystem 400 through the supply passage 415. When the rocker arm 310 is in contact with the cam 110 base circle, the master piston 410 attains its lower most position in the bore 411. As the cam 110 continues to rotate, the rocker arm 310 begins to contact the main valve event lobe 112 of the cam 110, causing the first end 312 of the rocker arm 310 to begin to rotate in an upward direction. Correspondingly, the second end 314 of the rocker arm 310 begins to rotate in a downward direction. The motion of the second end 314 of the rocker arm 310 begins to take up the lash L, but does not cause the rocker arm 310 to actuate the engine valves 200. The recess 316 formed in the rocker arm 310 permits the rocker arm to rotate without acting on the actuation pin 210.

As the first end 312 of the rocker arm 310 rotates in an upward direction, the rocker arm 310 contacts the master piston 410, causing the master piston 410 to move in an upward direction within the bore 411. The upward motion of the master piston 410 is transferred through hydraulic pressure in the passage 404 to the slave piston 420. This hydraulic pressure is sufficient to overcome the force of the spring 422 and causes the slave piston 420 to translate in a downward direction within the bore 421 and act on the actuation pin 210. This, in turn, causes the actuation pin 210 to act on a single valve 200, or on multiple valves 200 through the valve bridge 250, as shown in FIG. 3.

As the actuation pin 210 translates downward, the rocker contact surface 212 maintains separation from the second end 314 of the rocker arm 310. Because the rocker arm ratio is greater than the hydraulic ratio between the master piston 410 and the slave piston 420, however, the rocker arm 310 eventually catches up with and acts on the rocker contact surface 212, causing continued actuation of the engine valves 200. In this manner, the initial portion of the main event valve lift is provided by the second valve actuation subsystem 400, and the remaining portion of the main event valve lift is provided by the first valve actuation subsystem 300.

As the cam 110 continues to rotate, the rocker arm 310 begins to contact the EGR lobe 116 of the cam 110. This again causes the first end 312 of the rocker arm 310 to begin to rotate in an upward direction, and the corresponding downward motion of the second end 314 of the rocker arm 310. Again, the motion of the second end 314 of the rocker arm 310 takes up the lash L, but does not cause the rocker arm 310 to actuate the engine valves 200. As described above, the motion of the first end 312 of the rocker arm 310 causes the upward motion of the master piston 410 and corresponding downward motion of the slave piston 420. This, in turn, actuates the engine valves 200 to produce an EGR event. In this manner, the entire valve lift for the EGR event is provided by the second valve actuation subsystem.

During a second operating condition, for example, when EGR is not desired, hydraulic fluid is not supplied to the second valve actuation subsystem 400. As described above, when the rocker arm 310 begins to contact the main valve event lobe 112 of the cam 110, the first end 312 of the rocker arm 310 begins to rotate in an upward direction. This, in turn, causes the second end 314 of the rocker arm 310 to rotate in a downward direction, taking up the lash L. The first end 312 of the rocker arm 310 contacts the master piston 410, as before, causing the master piston 410 to move in an upward direction within the bore 411. Because hydraulic fluid is not supplied to the second valve actuation subsystem 400, however, the motion of the master piston 410 is not transferred to the slave piston 420. The slave piston 420 correspondingly does not act on the pin 210. As the rocker arm 310 continues to rotate, the second end 314 contacts the rocker contact surface 212 of the pin 210. This causes the pin 210 to act on the valve bridge 250 and actuate the engine valve(s) 200. In this manner, the entire main event valve lift is provided by the first valve actuation subsystem 300. The lift ratios of the two valve actuation subsystems may be designed such that the engine valve(s) 200 do not experience a loss of main event lift due to the lash L.

When the rocker arm 310 begins to contact the EGR lobe 116 of the cam 110, the first end 312 of the rocker arm 310 again begins to rotate in an upward direction, and the second end 314 rotates in a downward direction. The motion of the second end 314 of the rocker arm 310 takes up the lash L, but does not cause the rocker arm 310 to actuate the engine valves 200. Because the lash L is greater than the height of the EGR lobe 316, the entire motion provided by the lobe is "absorbed," and the engine valve(s) 200 are not actuated. In this manner, during the second operating condition, the engine valve(s) 200 are not actuated to produce an exhaust gas recirculation event.

It will be apparent to those skilled in the art that variations and modifications of the present invention can be made without departing from the scope or spirit of the invention. For example, it is contemplated that the size, shape, and timing of the EGR event may vary depending on a variety of factors, including, but not limited to, the lash L, valve clipping mechanisms, selective hydraulic ratios, and reset mechanisms. Thus, it is intended that the present invention cover all such modifications and variations of the invention, provided they come within the scope of the appended claims and their equivalents.

What is claimed is:

1. A system for selectively providing exhaust gas recirculation (EGR) during a positive power engine operating condition having at least one engine valve, said system comprising:

a cam having a main exhaust lobe and a EGR lobe;

a first valve actuation subsystem for transferring (i) a portion of the main exhaust motion from said cam to the engine valve during the positive power engine operating condition, wherein said transferred portion is less than that transferred during a second engine operating condition, and (ii) all of the main exhaust motion from said cam to the engine valve during the second engine operating condition; and a second valve actuation subsystem for transferring EGR motion and a second portion of the main exhaust motion from said cam to the engine valve during the positive power engine operating condition.

2. The system of claim 1, wherein the second engine operating condition comprises engine braking operation.

3. The system of claim 1, wherein said first valve actuation subsystem comprises a rocker arm having a rocker ratio, and said second valve actuation subsystem comprises a master piston and a slave piston having a hydraulic ratio, and wherein the hydraulic ratio is less than the rocker ratio.

4. The system of claim 1, wherein the second valve actuation subsystem comprises a hydraulically actuated slave piston and an actuation pin disposed between the slave piston and the at least one engine valve, and wherein said first valve actuation subsystem comprises a rocker arm having a first end for deriving motion from said cam, and a forked second end for receiving and selectively contacting the actuation pin.

5. The system of claim 1, further comprising a push tube disposed between said cam and said first valve actuation subsystem.

6. A method of providing exhaust gas recirculation during a positive power engine operating condition of an engine, said method comprising the steps of:

providing engine valve train motion to a first valve actuation subsystem and a second valve actuation subsystem;

during the positive power engine operating condition, providing valve actuation for (i) a main exhaust event using the first valve actuation subsystem and the second valve actuation subsystem, and (ii) an exhaust gas recirculation event using the second valve actuation subsystem; and during a second engine operating condition, (i) providing valve actuation for the main exhaust event using the first valve actuation subsystem exclusively, and (ii) discontinuing valve actuation for exhaust gas recirculation events.

* * * * *